US010588729B2

(12) United States Patent
Moons

(10) Patent No.: US 10,588,729 B2
(45) Date of Patent: Mar. 17, 2020

(54) APPARATUS FOR INJECTING A LIQUID INTO LIVE ANIMALS

(71) Applicant: Intervet Inc., Madison, NJ (US)

(72) Inventor: Mathias Theodorus Maria Moons, Son (NL)

(73) Assignee: Intervet Inc., Madison, NJ (US)

( * ) Notice: Subject to any disclaimer, the term of this patent is extended or adjusted under 35 U.S.C. 154(b) by 0 days.

(21) Appl. No.: 14/783,488

(22) PCT Filed: Apr. 15, 2014

(86) PCT No.: PCT/EP2014/057621
§ 371 (c)(1),
(2) Date: Oct. 9, 2015

(87) PCT Pub. No.: WO2014/170325
PCT Pub. Date: Oct. 23, 2014

(65) Prior Publication Data

US 2016/0051352 A1 Feb. 25, 2016

(30) Foreign Application Priority Data

Apr. 16, 2013 (EP) ..... 13163869

(51) Int. Cl.
*A61D 1/02* (2006.01)

(52) U.S. Cl.
CPC ..... *A61D 1/025* (2013.01)

(58) Field of Classification Search
CPC ..... A61M 39/284; A61M 5/14224; A61M 5/14546; A61M 5/42; A61M 5/427;
(Continued)

(56) References Cited

U.S. PATENT DOCUMENTS

2007/0093747 A1 4/2007 Smith
2008/0177223 A1* 7/2008 Johnston ..... A61D 1/025 604/68

(Continued)

FOREIGN PATENT DOCUMENTS

FR 2839245 7/2003
FR 2839245 A1 * 11/2003 ..... A61D 1/005
FR 2930425 A1 10/2009

OTHER PUBLICATIONS

English translation of FR2839245.*

(Continued)

*Primary Examiner* — Kevin C Sirmons
*Assistant Examiner* — Alexandra Lalonde

(57) ABSTRACT

An apparatus for injecting a liquid into live animals, comprising a cradle plate (18) having a cradle (24) for accommodating at least a part of an animal, sensors (20-1, 20-2, 20-3) for detecting a force acting upon the cradle plate, an injection mechanism (16) for injecting liquid into the animal, and a control unit (38) for triggering the injection mechanism (16) in response to signals received from the sensors, wherein at least three sensors (20-1-, 20-2, 20-3) are arranged for measuring forces with which the cradle plate (18) is pressed against a base (12) in at least three non-aligned positions, and the control unit (38) is adapted to trigger the injection mechanism (16) when the forces measured by the sensors are distributed according to a predetermined pattern.

17 Claims, 4 Drawing Sheets

(58) Field of Classification Search
CPC ..... A61M 2205/6072; A61M 2205/00; A61M 2205/60; A61M 2205/6018; A61M 2240/00; A61M 2250/00; A61D 1/025; A61D 7/00; A01K 35/00; A01K 45/007; A01K 11/00; A01K 11/005; A01K 11/006; A01K 11/007; A01K 11/008; A01K 13/003
See application file for complete search history.

(56) References Cited

U.S. PATENT DOCUMENTS

| | | | | |
|---|---|---|---|---|
| 2011/0054401 | A1* | 3/2011 | Jorna | A61D 1/025 604/131 |
| 2012/0179132 | A1* | 7/2012 | Valk | A61M 5/1452 604/500 |
| 2013/0274655 | A1* | 10/2013 | Jennings | A61M 5/20 604/67 |
| 2013/0317454 | A1* | 11/2013 | Grant | A61M 39/284 604/250 |

OTHER PUBLICATIONS

European Search report for 13163869.4 dated Nov. 6, 2013, 5 pages.
International search report for 057621 dated Jul. 8, 2014, 4 pages.
English translation of FR2930425 using internet translation service on Apr. 28, 2017, 8 pages.
English translation of FR2839245 using external translation service company, 10 pages.

* cited by examiner

APPARATUS FOR INJECTING A LIQUID INTO LIVE ANIMALS

CROSS-REFERENCE TO RELATED APPLICATIONS

This application is a national stage entry under 35 U.S.C. § 371 of PCT/EP2014/057621, filed on Apr. 15, 2014, which claims priority under EP 13163869.4, filed on Apr. 16, 2013, the contents of both of which are hereby incorporated by reference in their entireties.

The invention relates to an apparatus for injecting a liquid into live animals, comprising a cradle plate having a cradle for accommodating at least a part of an animal, sensors for detecting a force acting upon the cradle plate, an injection mechanism for injecting liquid into the animal, and a control unit for triggering the injection mechanism in response to signals received from the sensors.

More particularly, the invention relates to a vaccinating apparatus, in particular for vaccinating chicken or other birds.

FR 2 930 425 discloses a vaccinating apparatus of the type indicated above, wherein the presence of a bird in the cradle is detected with two sensors which trigger the injection mechanism. In order to inject to vaccine, two syringes are thrust forward so that their needles pass through openings in the cradle and penetrate the skin of the chicken. The cradle is configured as a chute with a V-shaped cross-section. When a chicken is manually pressed against the cradle plate, there is a relatively high risk that the chicken is not held in the correct position relative to the injection needles, so that the injection cannot be applied properly or may even course damage to essential organs of chicken.

WO 2009/030755 A1 discloses a vaccinating apparatus wherein three contract sensors are mounted in recesses in the internal surface of the cradle. The injection is triggered when all three sensors are contacted by the chicken. In this apparatus, the posture of the chicken during the injection can be controlled more reliably. However, it is difficult to mount and properly adjust the sensors in the recesses of the cradle plate, and these recesses and the sensors are difficult to clean, which, since the sensors come into direct contact with the chicken, leads to a substantial risk of infection.

It is an object of the invention to provide an injection apparatus with improved operational safety and hygiene.

In order to achieve this object, according to the invention, at least three sensors are arranged for measuring forces with which the cradle plate is pressed against a base in at least three non-aligned positions, and the control unit is adapted to trigger the injection mechanism when the forces measured by the sensors are distributed according to a predetermined pattern.

The measured distribution of forces will only correspond to the predetermined pattern if the relevant part of the chicken, e.g. the breast, is properly accommodated in the cradle and the chicken is pressed against the cradle plate in the correct direction and with the correct force. In this way, it can be assured reliably that the injection is triggered only when the posture of the chicken is optimal for the injection. Since the force sensors may be arranged such they do not come into direct contract with the chicken, the cradle may have a smooth internal surface which is easy to clean and has superior hygiene properties.

More specific features and further developments of the invention are indicated in the dependent claims.

A preferred embodiment will now be described in conjunction with the drawings, wherein.

Figure 1:
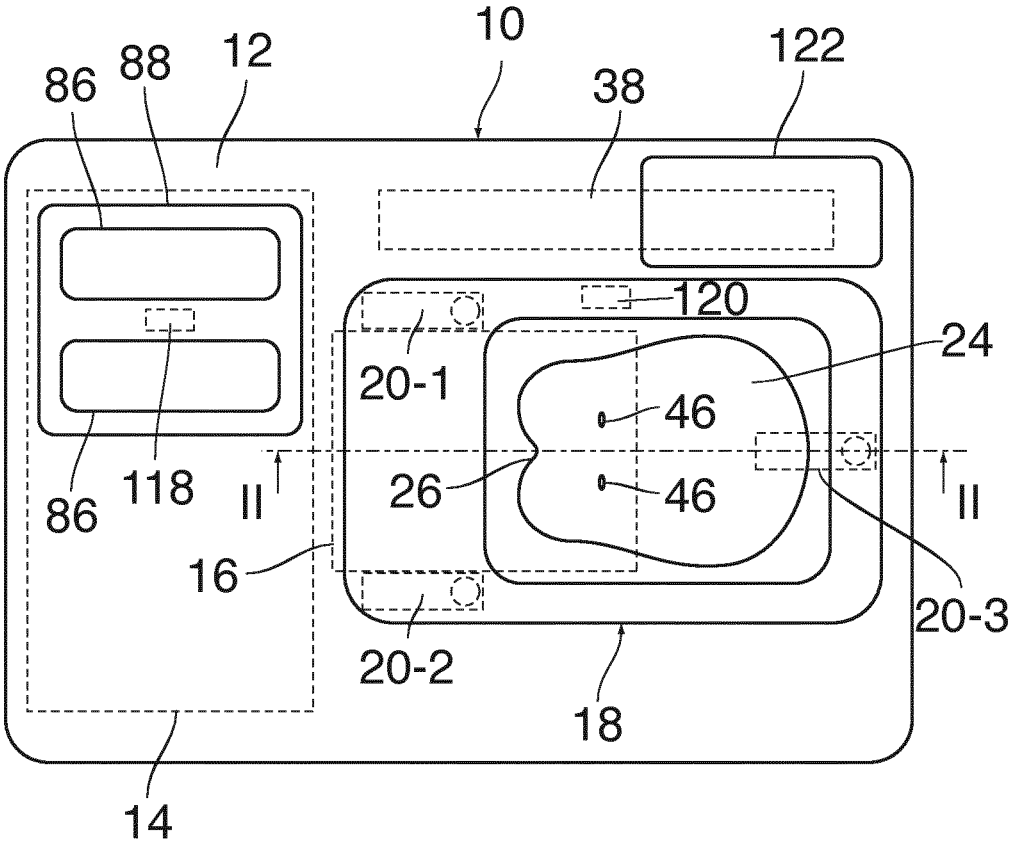
FIG. 1 is a plan view of a vaccinating apparatus according to the invention.

The apparatus shown in FIG. 1 has a casing 10 with a flat top surface formed by a base plate 12. The casing 10 accommodates a vaccine metering and supply mechanism 14 and an injection mechanism 16 which have both been shown only schematically in FIG. 1.

A cradle plate 18 is amounted on top of the casing 10 and is supported on the base plate 12 by three force sensors 20-1, 20-2 and 20-3. The positions of the force sensors correspond to the corners of an isosceles triangle, so that the cradle plate 18 is stably supported on the base plate 12.

Figure 2:
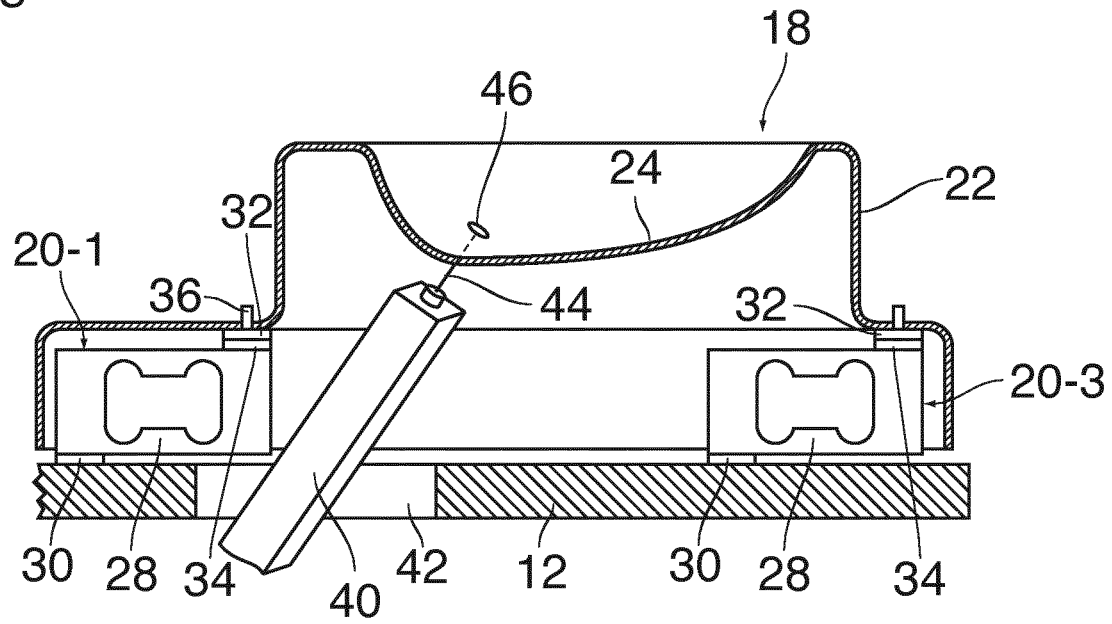
FIG. 2 is a cross-sectional view taken along the line II-II in FIG. 1.

As can be seen more clearly in FIG. 2, the cradle plate 18 has an elevated part 22 the top surface of which defines a concave cradle 24 which matches the shape of a breast of a chicken. As can be seen in plan view in FIG. 1, the top edge of the cradle forms an inwardly projecting nose 26 that matches the clavicles of the chicken, so that the body axis of the chicken can be aligned with the longitudinal axis of the cradle 24. The force sensors 20-1 and 20-2 are arranged symmetrically with respect to the longitudinal axis of the cradle 24 on the side of the cradle plate that corresponds to the head of the chicken, whereas the force sensor 20-3 is positioned on the rear side and on the longitudinal axis.

All three force sensors are located outside of the footprint of the cradle 24, so that any imbalance in the applied force can be detected with high sensitivity.

In this example, as shown in FIG. 2, the force sensors are constituted by cantilevered bending bars 28 each of which has one end 30 secured on the base plate 12 whereas the opposite end supports the cradle plate 18. The elevated part 22 of the cradle plate is surrounded by a flat plate portion which has three magnets 32 (or at least plates of a magnetizable material) on the bottom side. The magnets 32 are attracted by respective magnets 34 that are secured on the top side of each bending bar 28 at the free end thereof. Thus, the cradle plate 18 is safely held in position on the force sensors and nevertheless can be detached and replaced easily. In the example shown, positioning pins 36 are additionally provided for defining the position of the cradle plate relative to the force sensors more accurately.

In a manner known per-se, the bending bars 28 are equipped with strain gauges (not shown) which provide an electric signal that depends sensitively to the bending strain applied to the bending bar 28 and, accordingly, also on the force that the corresponding part of the cradle plate exerts upon the free end of the bending bar.

An electronic control unit 38 processes the electric signals from the three forces sensors 20-1, 20-2 and 20-3 for triggering the injection mechanism 16 when a chicken has been applied against the cradle 24 in the correct posture, as will be explained later in conjunction with FIGS. 3 and 4.

Figure 5:
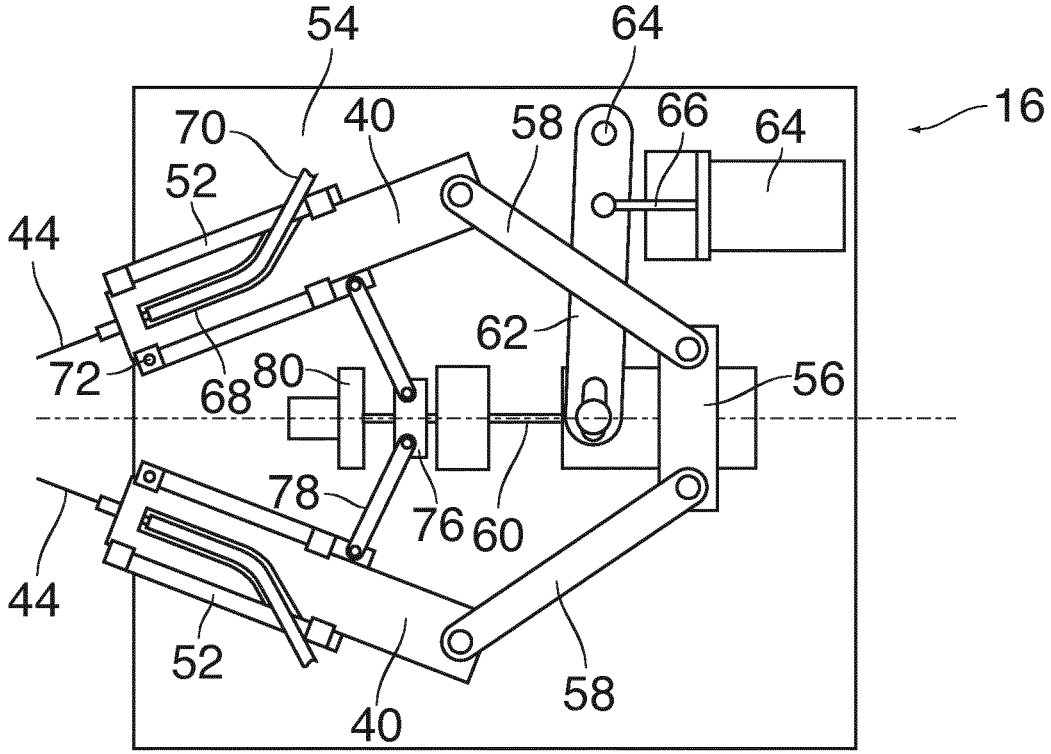
FIGS. 5 and 6 are plan views of an injection mechanism in two different state of operation.
Figure 6:
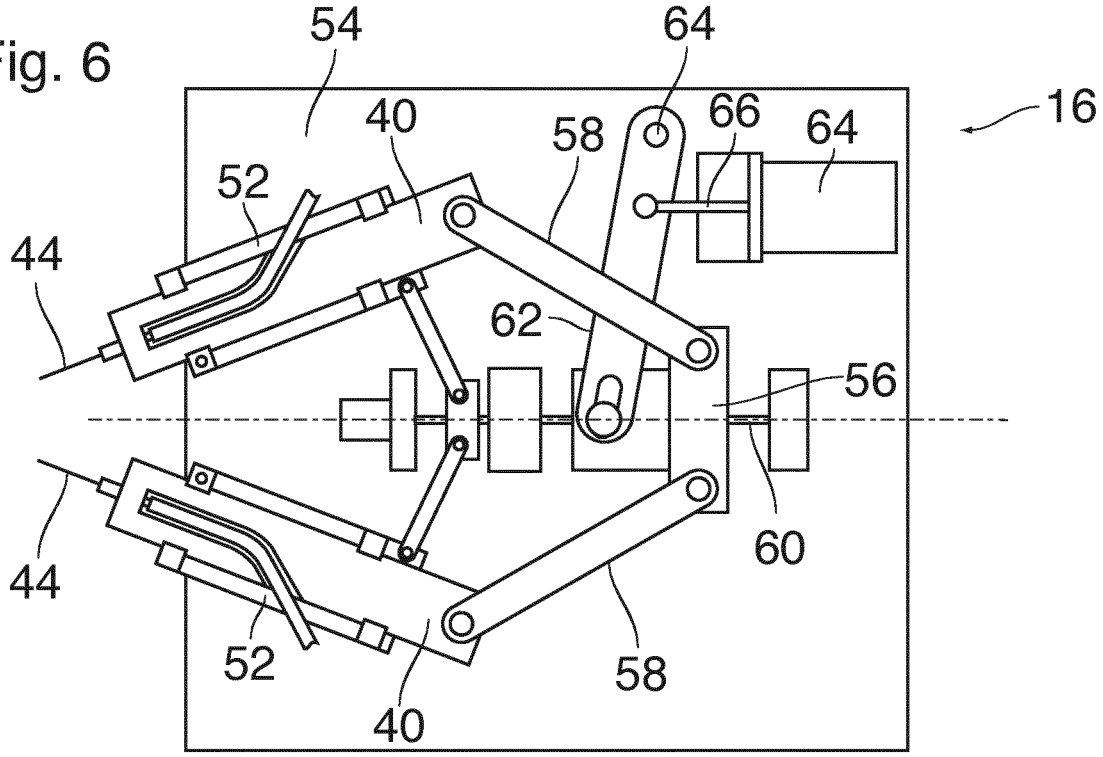

FIG. 2 shows a part of the injection mechanism 16, namely a needle holder 40 that projects upwardly towards the cradle 24 through a window 42 formed in the base plate 12. The needle holder 40 is held in an inclined position, so that an injection needle 44 held at the tip end thereof points towards a little hole 46 in the wall of the cradle 24 and extends essentially normal to the plane of the wall of the cradle 24 at the position of the hole 46. An actuating mechanism that will be described later in conjunction with FIGS. 5 and 6 is adapted to push the needle holder 40 forward so that the injection needle 44 passes through the hole 46 and penetrates the skin of the chicken so as to inject the vaccine.

As is shown in FIG. 1, the cradle 24 has two holes 46 arranged symmetrically with respect to the longitudinal axis of the cradle. The injection mechanism 16 comprises a symmetric arrangement of two needle holders each of which is associated with one of the holes 46.

In an idle condition, when no chicken is accommodated in the cradle 24, the force sensors 20-1, 20-2 and 20-3 will measure forces that correspond to the weight of the cradle plate. When a chicken is pressed against the cradle plate, so that its breast fits in the cradle, the force measured by each of the force sensors is increased by a certain value ΔF1, ΔF2, ΔF3 that depends on the force with which the chicken is pressed against the cradle plate, the position of the chicken relative to the cradle 24 and the direction of the force which the operator exerts manually onto the chicken. In this example, the force sensors 20-1, 20-2, 20-3 measure only the component of the force that is oriented normal to the plane of the base plate 12. When the vector of the force that is manually exerted on the chicken is not directed normal to the plane of the base plate 12, the inclination of this vector will induce a certain imbalance between the forces ΔF1, ΔF2, ΔF3. When the chicken is placed in the cradle in the correct posture and applied against the bottom of the cradle with the correct force vector, the forces ΔF1 and ΔF2 measured with the two front force sensors 20-1 and 20-2 can be expected to be larger than the force ΔF3 measured with the rear force sensor 20-3. The forces ΔF1 and ΔF2 should be essentially equal. A significant difference between these forces would indicate that the operator pushes the chicken in a lateral direction of the cradle. Thus, the distribution of the forces ΔF1, ΔF2 and ΔF3 indicates whether or not the chicken is held in the correct position.

Figure 3:
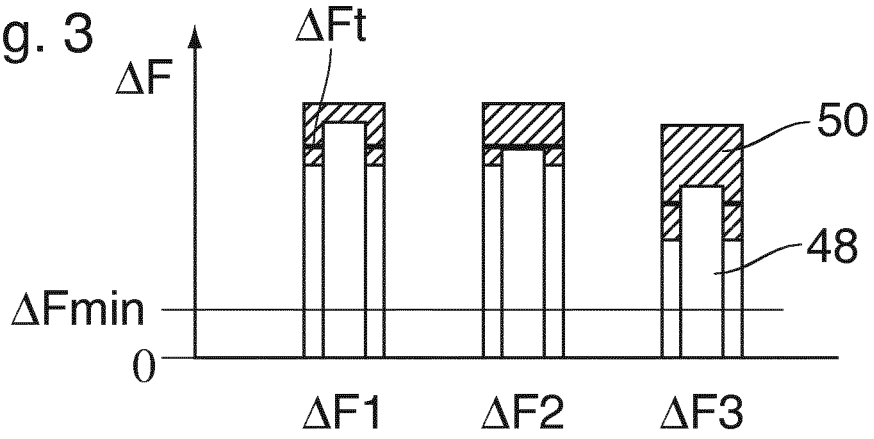
FIG. 3 is a diagram illustrating a function principle of the invention.

A typical pattern of the distribution of the forces ΔF1, ΔF2 and ΔF3 has been illustrated in the diagram shown in FIG. 3. The measured forces ΔF1, ΔF2, ΔF3 are symbolized in vertical bars 48. Further, a target value ΔFt and a tolerance range 50 have been shown for each of the bars 48. In the example shown in FIG. 3, the top ends of all tree bars 48 are within their respective tolerance range 50, which indicates that the measured force distribution is acceptable, i.e. the chicken is held in the right posture and pressed against the cradle plate with an appropriate force. Under these conditions, the control unit 38 would trigger the injection mechanism 16.

Figure 4:
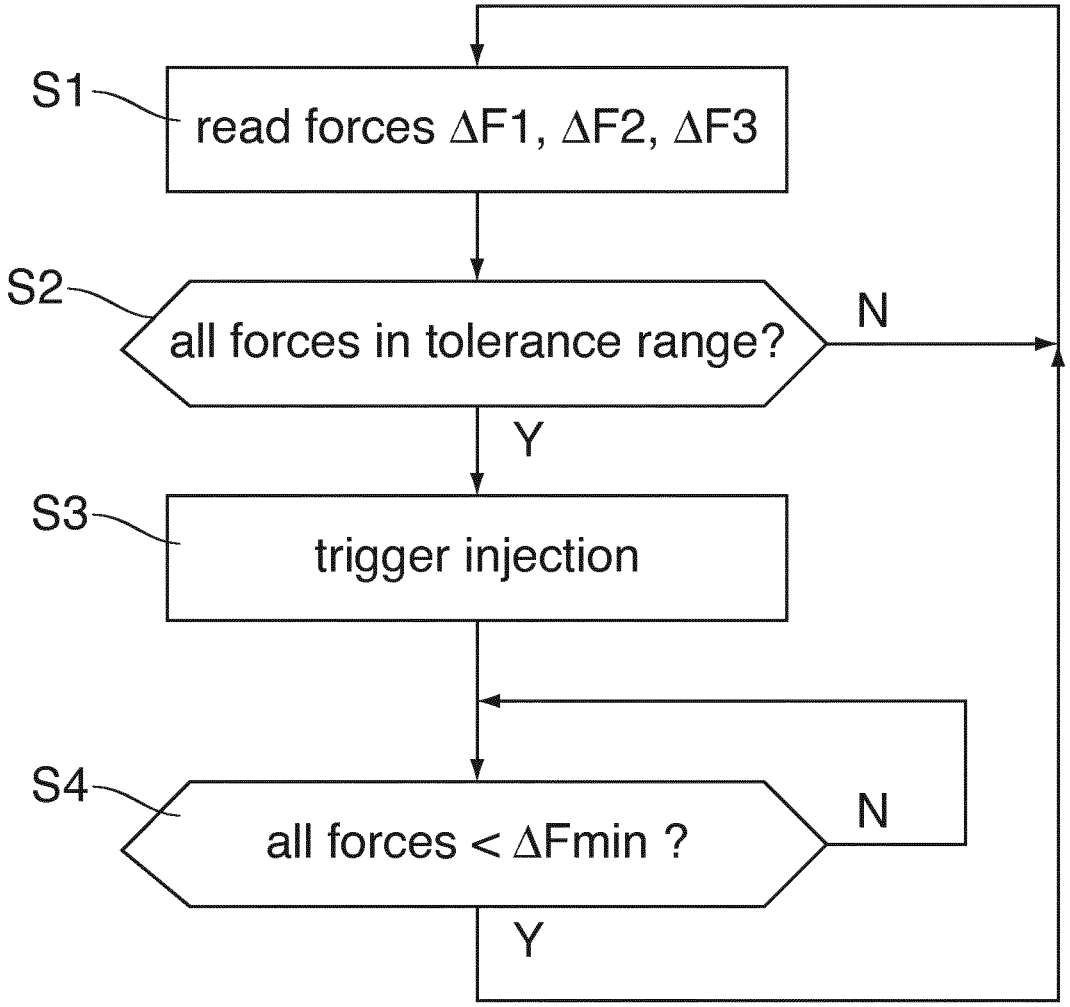
FIG. 4 is a flow chart of a process for triggering an injection.

A corresponding control algorism has been shown in FIG. 4. In step S1, the control unit reads the (differential) forces ΔF1, ΔF2, ΔF3 as measured by the force sensors. It is checked in step S2 whether all forces are in their tolerance range (as shown in FIG. 3). If this condition is not fulfilled (N) the process returns to step S1, and the steps S1 and S2 are looped-through until the chicken is held in the correct posture. Then, when all forces are in the tolerance range (Y), the injection is triggered in step S3. Then, while the control unit 38 continuous to read the actual force values measured by the force sensors, it is checked in step S4 whether all forces have dropped below a certain threshold value ΔFmin, indicating that the operator has removed the chicken from the cradle plate. If this condition is not (yet) fulfilled, the process loops back to repeat step S3, until the condition is fulfilled, whereupon the process returns to step S1, i.e. the apparatus is ready for vaccinating the next chicken. Thus, step S4 assures that no chicken will be vaccinated twice.

In the example shown here, the criterion for triggering the injection is that all measured differential forces are within a certain tolerance range. However, other criteria may be used as well. For example, the triplet (ΔF1, ΔF2, ΔF3) may be considered as a vector VF and may be compared to a certain reference vector VR which indicates the target values of the three forces. Then, the criterion for triggering the injection may be that the absolute value→VF−VR→is smaller than a certain threshold value or that $(VF-VR)^2$ is smaller than a certain threshold value. In yet another embodiment, the vector VF may be normalized and it may then be checked whether the scalar product VF·VR with a normalized reference vector is sufficiently close to 1.

In yet another embodiment, the criterion illustrated in FIG. 3 may be supplemented by an additional criterion requiring that the difference→ΔF1−ΔF2→is smaller than a certain threshold value. This means to require that no lateral force is applied to the chicken, i.e. the difference between ΔF1−ΔF2 has to be small whereas the average of ΔF1 and ΔF2 may vary in a larger tolerance range.

A useful embodiment of the injection mechanism 16 will now be explained by reference to FIGS. 5 and 6.

As is shown in FIG. 5, the two needle holders 40 are mounted on respective guide blocks 52 that are held symmetrically on a common plate 54. The rear end of each needle holder 40 is connected to a carriage 56 via an articulated link 58. The carriage 56 can travel along a path that extends in parallel with the plate 54 and in the plane of symmetry of the needle holders 40. In this example, the path of the carriage 56 is defined by a guide rod 60.

The carriage 56 is articulately connected to a free end of a lever 62 that is mounted on the plate 54 so as to be rotatable about an axis 64. An electric motor 64, e.g. a step motor with integrated spindle drive, is arranged to induce an axial movement of a push rod 66 that is connected to a point of the lever 62 between the opposite ends thereof, but closer to the axis 64.

When the motor 64 is actuated by the control unit 38 and the push rod 66 is extended, as is shown in FIG. 6, the lever 62 turns clock-wise about the axis 64 and causes the carriage 56 to move to the right along the guide bar 60. As a consequence, the links 58 will push the needle holders 40 rightwards, so that they will slide in their guide blocks 52 so as to push the needles 44 forward (through the openings 46 which are not shown in FIGS. 5 and 6).

As is further shown in FIGS. 5 and 6, each needle holder 40 has a guide channel 68 that accommodates one end of a flexible tube 70 that is connected to the needle 44 and supplies liquid (vaccine) from the metering and supply mechanism 16, so that the vaccine is injected.

In the example shown, each of the guide blocks 52 is rotatable relative to the plate 54 about a pivot pin 72 in the vicinity of its front end, and the rear end is connected to another carriage 76 in via an articulated link 76. The position of the carriage 76 along the guide bar 60 is adjustable. For example, a front end portion of the guide rod 60 may be configured as a spindle that is in thread-engagement with the carriage 76 and may be rotated manually by means of a knob 80.

When the carriage 76 is moved leftwards, for example, the links 78 will spread the rear ends of the guide blocks 52 further apart, so that the guide blocks will tilt about the pivot pins 72, and the angle formed between the longitudinal axes of the needle holders 40 and the needles 44 will become larger. In this way, the injection mechanism may be adjusted to a different type of animal, e.g. chickens of a different size. In that case, the cradle plate 18 will be replaced by another cradle plate having a cradle in a shape adapted to the new type of animal and with the holes 46 in positions corresponding to the changed positions of the needles 44.

The pivotal movement of the guide blocks 52 will of course also translate into a linear movement of the carriage 56. This movement may however be absorbed, for example by re-adjusting the zero position of the motor 64.

A useful embodiment of the metering and supply mechanism 14 will now be described in conjunction with FIGS. 7 and 8. The mechanism 14 comprises two supply units 82, one for each of the two needles 44. The supply units 82 are disposed symmetrically on a common plate 84.

Figure 7:
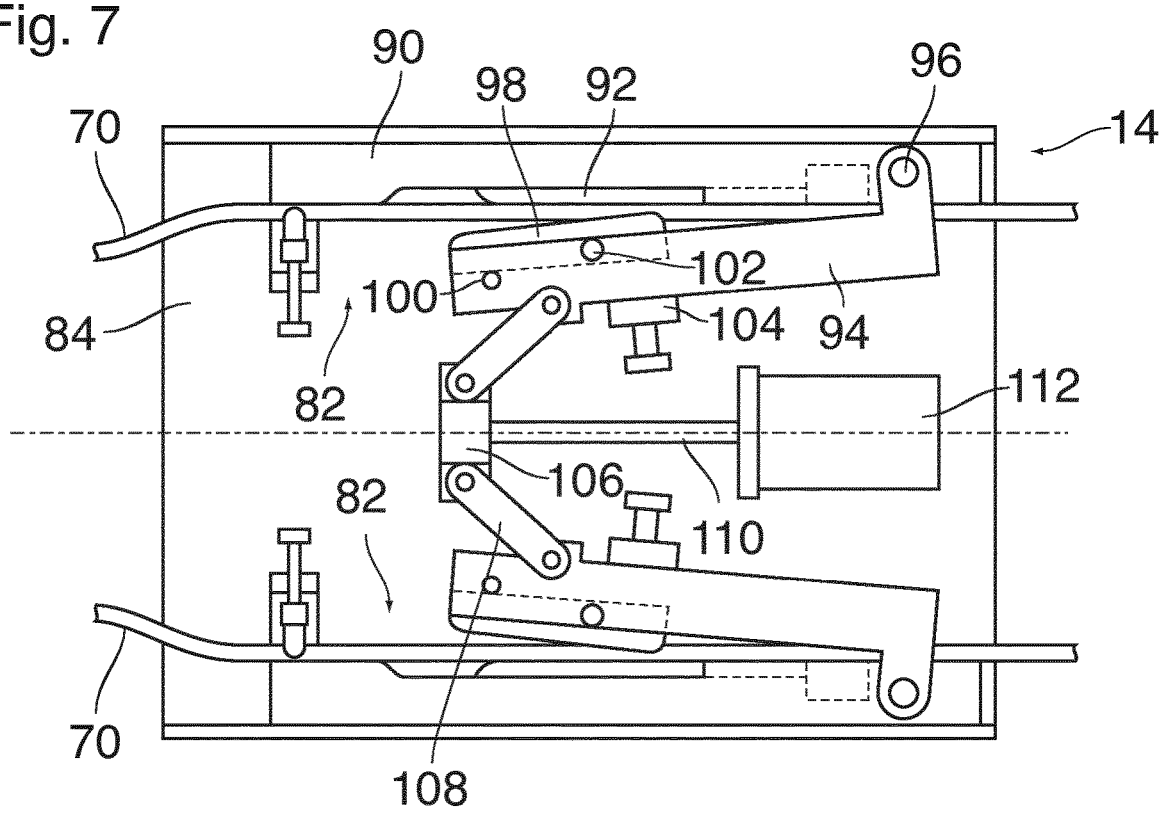
FIGS. 7 and 8 are plan views of a liquid metering and supply mechanism in two different states of operation.

FIG. 7 shows portions of the two flexible tubes 70. The ends of the tubes 70 on the left side in FIG. 7 are connected to the needle holders 40, whereas the ends shown on the right side are connected to two liquid bottles 86 which have been shown in FIG. 1. The bottles 86 are held in a dome 88 that raises up from the base plate 12, so that the bottoms of the bottles 86 are located higher than the supply units 82, assuring a flow of the liquid to the supply units 82 under the force of gravity. The bottles 86 are detachably inserted into slots of the dome 88 and are coupled to the tubes 70 by automatic couplings (not shown).

In the supply units 82, each tube 70 is supported at a backing plate 90 and, on a part of its length, at an adjustable backing member 92 that is slidable in a recess of the backing plate 90 and has, on the side facing the tube 70, a surface that is flush with the surface of the backing plate 90 outside the recess.

A lever 94 is connected to the backing plate 90 by an articulated joint 96 and carries a pressure member 98 at its free end. The pressure member 98 has a portion that is accommodated in the lever 94 and another portion projecting towards the tube 70. The left end of the pressure member 98 in FIG. 7 is rotatably supported at a pin 100. Closer to the right end, the pressure member 98 has guide pin 102 that moves in an arcuate slot (not shown) of the lever 94, so that the pressure member is guided to perform a rotating movement with the pin 100 as a fulcrum. The rightmost end of the pressure member 98 is biased towards the tube 70 with adjustable force by means of a spring mechanism 104.

The free ends of the levers 94 carrying the pressure members 98 are connected to a common slide 106 by means of two articulated links 108. The slide 106 is connected to one end of a rotating spindle 110 of a linear drive motor 112.

Figure 8:
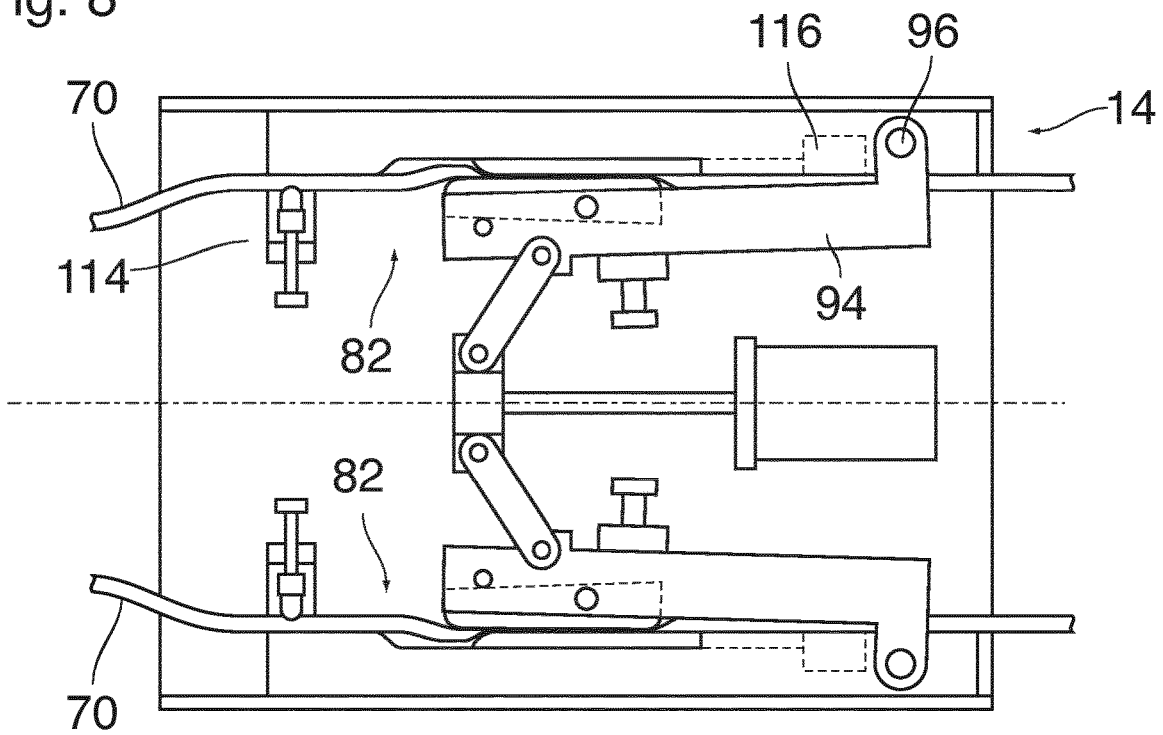

When the drive motor 112 is actuated to retract the spindle 110, as is shown in FIG. 8, the slide 106 moves rightwards, whereas the levers 94 are supported by the joints 96. As a result, the links 108 press the free ends of the levers 94 apart, so that the pressure members 98 are moved against the backing plates 90. Since the rear edge (at the right end) of the pressure member 98 is biased by the spring mechanism 104, it will quench the flexible tube 70 first, thereby preventing the liquid from flowing back towards the bottle. As the pivotal movement of the levers 94 continues, the spring mechanisms 104 will yield and the pressure members 98 will pivot about the pins 100, until the flat surface of the pressure member 98 facing the tube 70 reaches a position parallel to the surface of the backing member 92 and quenches the tube on the entire length of the tube portion that is situated between the pressure member 98 and the backing member 92. As a result, the liquid contained in this portion of the tube is gradually squeezed-out towards the left side in FIG. 8.

At the left end of the backing plates 90, the tubes 70 are closed off by quench valves 114 with an adjustable quenching force. When the liquid is squeezed out by the pressure member 98, the pressure of the liquid in the portion between the pressure member and the backing member 92 on the one end and the quench valve 114 on the other end increases until the quench valve 114 opens and a metered amount of liquid is supplied towards the needle 44 and injected. As soon as the liquid has been squeezed out completely by the pressure members, the quench valves 114 will close again, preventing a back flow of the liquid in the phase when the levers 94 return to their start position shown in FIG. 7.

The amount of liquid that is injected in a single operation cycle is determined by the length on which the pressure member 98 and the backing member 92 overlap. This amount can consequently be adjusted, individually for each supply unit 82, by changing the position of the backing member 92 in the recess of the backing plate 90. The adjustment may be performed manually or automatically by means of a linear drive mechanism 116 (FIG. 8) under the control of the control unit 38.

The metering and supply mechanism that have been described above have the advantage that is permits a quick and reliable injection of a precisely metered amount of liquid with suitable injection pressure and is easy to clean, simply by scavenging the tubes 70.

It will be understood that the stroke of the slide 106 is controlled by the control unit 38 which controls the drive motor 112. Likewise, the forward movement of the injection needles 44 in FIGS. 5 and 6 is controlled by the drive motor 64, also under the control of the control unit 38. Thus, when an injection cycle is triggered in step S3 in FIG. 4, the drive motors 64 and 112 will be actuated at suitable timings.

As is shown in FIG. 1, a bar code reader 118 is disposed between the slots for the bottles 86 and is capable of reading bar codes on the two bottles, indicating the contents of the bottles and related information, including dosage information and, as the case may be, information on the suitable injection pressure or duration of the injection. The latter information will be used by the control unit 38 to control the operation (speed) of the drive motor 112. If the backing members 92 can be adjusted automatically by means of the drive mechanisms 116, then the control unit 38 may also use the dosage information for automatically setting the appropriate positions of the backing members 92.

As is further shown in FIG. 1, another bar code reader 120 is disposed to face the cradle plate 18 so as to read a bar code on the cradle plate, which code indicates the type of animal for which the cradle plate is to be used and explicitly or implicitly, the required posture of the needles 44.

A control panel is connected to the control unit 38 and includes a display 122 for outputting operating instructions to the operating personnel. For example, these instructions may tell the operator, depending upon the information read from the bar code reader 120, how to adjust the angular position of the slide blocks 52 and hence the injection needles 44 by means of the knob 80 (FIG. 5).

In another embodiment, the position of the carriage 76 may be adjusted automatically by means of the control unit 38, based on the information read from the bar code reader 120.

Of course, instead of the bar code reader 120, any other suitable encoding techniques (including mechanical keys and the like) may be used for inputting information on the identity of a cradle plate 18 into the control unit 38.

Moreover, the bar codes (or other codes) on the bottles 86 may indicate the type of animal for which the vaccine is to be used, and this will cause the control unit 38 to advise the operator via the display 122 which type of cradle plate 18 should be mounted. The reader 120 may then be used for confirming that the operator has mounted the right cradle plate.

The invention claimed is:

1. An apparatus for injecting a liquid into live animals, comprising a movable cradle plate (18) having a cradle (24) for accommodating at least a part of an animal, a plurality of sensors comprising at least three sensors (20-1, 20-2, 20-3) for detecting a plurality of forces (ΔF1, ΔF2, ΔF3) acting upon the cradle plate, an injection mechanism (16) for injecting the liquid into the animal, and a control unit (38) for triggering the injection mechanism (16) in response to signals received from the plurality of sensors, characterized in that the plurality of sensors (20-1, 20-2, 20-3) are arranged for measuring the plurality of forces (ΔF1, ΔF2, ΔF3) with which the cradle plate (18) is pressed against a base (12) in at least three non-aligned positions, and the control unit (38) is adapted to trigger the injection mechanism (16) when the plurality of forces measured by the plurality of sensors (20-1, 20-2, 20-3) are distributed according to a predetermined pattern;

wherein the plurality of sensors are arranged so that the plurality of sensors do not come into direct contact with the animal;

wherein the cradle plate (18) is held in position on the plurality of sensors (20-1, 20-2, 20-3), and the plurality of sensors (20-1, 20-2, 20-3) contact the bottom of the cradle plate (18);

wherein one end of each of the plurality of sensors (20-1, 20-2, 20-3) is secured on the base (12) whereas the opposite end of each of the plurality of sensors supports the cradle plate (18); and wherein the cradle plate (18) is configured to exert a force upon the plurality of sensors (20-1, 20-2, 20-3) when the cradle plate (18) is pressed against the base (12), which force results in a strain applied to the plurality of sensors (20-1, 20-2, 20-3); whereby the cradle plate (18) moves towards the base (12).

2. The apparatus according to claim 1, wherein the control unit (38) is adapted to compare the detected plurality of forces (ΔF1, ΔF2, ΔF3) to corresponding target values (ΔFt) and to trigger an injection when deviations of the detected plurality of forces from the corresponding target values are below predetermined limits.

3. The apparatus according to claim 1, wherein positions where the plurality of sensors (20-1, 20-2, 20-3) contact the cradle plate (18) are disposed outside of a footprint of the cradle (24).

4. The apparatus according to claim 1, wherein the cradle (24) has an axis of symmetry and the positions of the plurality of sensors (20-1, 20-2, 20-3), as seen in a plan view of the cradle plate (18), form an isosceles triangle with one corner located on the axis of symmetry in a vicinity of a portion of the cradle corresponding to a rear part of the animal, and with a base of the isosceles triangle being located on a side of the cradle corresponding to a head of the animal.

5. The apparatus according to claim 4, wherein the cradle plate (18) comprises three magnets or magnetisable elements (32), at sites corresponding to the plurality of sensors (20-1, 20-2, 20-3).

6. The apparatus according to claim 5, wherein the cradle plate (18) is provided with a machine readable code, wherein said machine readable code provides information on an identity of the cradle plate.

7. The apparatus according to claim 6 that further comprises instructions for setting an angle formed between two needles (44).

8. The apparatus according to claim 7, wherein the cradle plate (18) is one of a plurality of exchangeable cradle plates, and the control unit (38) is adapted to read a code on the plurality of exchangeable cradle plates, which code provides information on an identity of the plurality of exchangeable cradle plates, and to provide instructions for setting the angle formed between the longitudinal direction of the two needles (44).

9. The apparatus according to claim 1, wherein the cradle plate (18) is adapted to be held on the plurality of sensors (20-1, 20-2, 20-3) by magnetic attraction.

10. The apparatus according to claim 1, wherein the injection mechanism (16) comprises two injection needles (44), wherein each of the two injection needles is held by its respective needle holder (40), and wherein the two needle holders (40) are actuated by a common actuating mechanism for advancing the two injection needles to penetrate a skin of the animal.

11. The apparatus according to claim 10, wherein each needle holder (40) is mounted on its respective guide block (52) so that each needle holder will slide in its respective guide block in a longitudinal direction of the two respective injection needles (44), and wherein the actuating mechanism comprises articulated links (58) connecting the needle holders (40) to a common carriage (56) that is driven to move along an axis that bisects an angle formed between the longitudinal directions of the two needles (44).

12. The apparatus according to claim 11, wherein the angle formed between the longitudinal directions of the two needles (44) is adjustable.

13. The apparatus according to claim 12, wherein the cradle plate (18) is one of a plurality of exchangeable cradle plates, and the control unit (38) is adapted to read a code on the plurality of exchangeable cradle plates, which code provides information on an identity of the plurality of exchangeable cradle plates, and to provide instructions for setting the angle formed between the longitudinal direction of the two needles (44).

14. The apparatus according to claim 1, comprising a metering and supply mechanism (14) for supplying the liquid to the injection mechanism (16), said measuring and supply mechanism comprising a backing plate (90) that supports a portion of a flexible tube (70) connecting a needle (44) of the injection mechanism (16) to a liquid source, the mechanism further comprising a lever (94) driven to pivot against the backing plate (90) and carrying a pressure member (98) arranged to quench the tube (70) against the backing plate (90) so as to squeeze-out a metered amount of liquid.

15. The apparatus according to claim 14, wherein the backing plate (90) has a backing member (92) that is adjustable relative to the pressure member (98) for adjusting the metered amount of liquid.

16. The apparatus according to claim 14 that comprises at least one slot for detachably inserting a liquid source (86), and a reader (118) adapted to read a code from the liquid source, which code includes information on the liquid, and the control unit (38) is adapted to derive at least one injection parameter from the information read by the reader (118).

17. The apparatus according to claim 1, wherein the cradle plate (18) is supported on the base (12) by the plurality of sensors (20-1, 20-2, 20-3); and wherein the cradle plate has magnetizable material (32) on the bottom side, and the sensors (20-1, 20-2, 20-3) comprise a magnet (34), and said magnetizable material (32) is attracted to the magnet (34).

* * * * *